US006909441B2

(12) United States Patent
Hashimoto

(10) Patent No.: US 6,909,441 B2
(45) Date of Patent: Jun. 21, 2005

(54) METHOD AND DEVICE FOR DISPLAYING IMAGE

(75) Inventor: Yasunobu Hashimoto, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 478 days.

(21) Appl. No.: 10/057,870

(22) Filed: Jan. 29, 2002

(65) Prior Publication Data

US 2003/0076338 A1 Apr. 24, 2003

(30) Foreign Application Priority Data

Aug. 30, 2001 (JP) ..... 2001-261191

(51) Int. Cl.[7] ..... G09G 5/10
(52) U.S. Cl. ..... 345/690; 345/89; 315/169.3
(58) Field of Search ..... 345/60, 63, 76, 345/77, 89, 596–599, 690; 315/169.3, 169.4

(56) References Cited

U.S. PATENT DOCUMENTS 5,907,316 A * 5/1999 Mikoshiba et al. ..... 345/596
6,069,610 A * 5/2000 Denda et al. ..... 345/694
6,496,194 B1 * 12/2002 Mikoshiba et al. ..... 345/596

FOREIGN PATENT DOCUMENTS

| | | |
|---|---|---|
| JP | 9-172588 | 6/1997 |
| JP | 10-307561 | 11/1998 |
| JP | 11-224074 | 8/1999 |
| JP | 2000-105565 | 4/2000 |

* cited by examiner

*Primary Examiner*—Regina Liang
*Assistant Examiner*—Jennifer T Nguyen
(74) *Attorney, Agent, or Firm*—Staas & Halsey LLP

(57) ABSTRACT

A method for displaying an image is provided in which an optimal lighting pattern is selected so as to reduce pseudo contours and flickers. In an image display for reproducing halftones by a subframe technique, a frame is converted into plural subframes. For each of pixels of a display screen, the lighting pattern that is a combination of on and off of the subframes are determined in accordance with a frame data value of the noted pixel, a lighting pattern of the noted pixel in the past frame and the lighting pattern determined for the peripheral pixel located in the vicinity of the noted pixel and having the same display color as the noted pixel.

5 Claims, 16 Drawing Sheets

● : PIXEL WHOSE LIGHTING PATTERN IS BEING DETERMINED

⊙ : PERIPHERAL PIXEL TO BE REFERRED

METHOD AND DEVICE FOR DISPLAYING IMAGE

BACKGROUND OF THE INVENTION

1. Field of the Invention

The present invention relates to a method and device for displaying an image in which a halftone is reproduced by controlling a lighting time per frame and is suitable for a display using a plasma display panel (PDP) or an organic EL panel.

A PDP has two features of high speed and high resolution that are suitable for a television set and a computer monitor. A PDP is used for a large screen display device. One of tasks about a PDP is to reduce a pseudo contour and a flicker of an animation display.

2. Description of the Prior Art

A halftone is reproduced in a PDP by setting the number of discharge times in a frame for a cell (a display element) in accordance with a gradation level. A color display is one type of a gradation display, and a display color is determined by a combination of luminance levels of three primary colors.

As a method of a gradation display using a PDP, a subframe technique is widely known in which one frame is converted into a plurality of subframes having weights of luminance, and the total number of discharge times of one frame is set by combining on and off of the subframes (this is called a lighting pattern). Generally, the conversion from a frame into the subframes is performed by using a conversion table that was prepared in advance. In the case of an interlace display, each of fields making a frame is made of plural subfields, and lighting control is performed for each subfield. However, contents of the lighting control are similar to the case of a progressive display.

In a display with the lighting control in a subframe unit, lighting subframes and non-lighting subframes are mixed, so a timing of the light emission becomes discrete within a frame period. As a result, undesired flickers and pseudo contours may be generated. For example, if the light emission is concentrated in the first half of a display period and is concentrated in the second half of the successive frame of a certain frame, the time period of low luminance becomes long so that the distribution of the light emission along the time axis can be observed as a flicker to eyes of a human being. In addition, when displaying an image including an object that moves within a screen, the image of the noted cell moves on the observer's retina as the observer follows the object by his/her eyes. In this case, if an image of a cell having low light emission intensity stays on a certain point on the retina coincidentally, the surface of the object may be seen in low brightness corresponding to the point. When such points are coupled on a line, a string-like pattern may be observed on the surface of the object, which is called a pseudo contour. In other words, the pseudo contour is a phenomenon that an observer sees a light and dark pattern that is different from the display contents and is apt to be generated especially when an image portion made of pixels having a similar gradation level and a gentle gradient of density moves in a screen. For example, in a scene of a person walking, a portion of his/her face can generate a pseudo contour.

Conventionally, a method for reducing flickers and pseudo contours is known, in which the weighting is performed so that plural sets of subframe expressions can be realized for a halftone, and an optimal subframe expression is selected for each gradation level noting each frame. The basic concept of optimizing the subframe expression is to maintain a barycenter of light emission in a frame period without a substantial change corresponding to the gradation level as disclosed in Japanese unexamined patent publication No. 10-307561. For example, the barycenter of the light emission is set to the middle of the frame period. If the barycenter of the light emission is constant, the interval between the light emission barycenters of the frames also becomes constant, so that uneven distribution of the light emission timing such as a long period of low luminance can be eliminated.

In addition, Japanese unexamined patent publication No. 11-224074 proposes a method comprising the steps of noting a certain frame (i.e., the present frame) for determining a lighting pattern, referring a lighting pattern of a previous frame, and selecting an optimal lighting pattern considering the relationship between the previous frame and the present frame. By this method, the pseudo contours can be reduced more securely than the method in which only the present frame is noted for determining a lighting pattern. In addition, Japanese unexamined patent publications No. 9-172588 and No. 2000-105565 propose a method in which the lighting pattern is determined by considering a lighting pattern of the neighboring cell. By making the lighting pattern change as little as possible among the neighboring cells, the generation rate of the pseudo contours can be reduced.

As explained above, there was a problem that if the lighting pattern is determined by noting only the position of the barycenter, quality of the display depends on an extension of the light emission waveform. For example, if two light emission waveforms having the same barycenter as shown in FIGS. 21A and 21B appear alternately as shown in FIG. 22, the luminance is modulated with the period twice the frame period, and flickers can be observed even if the barycenter position is fixed. Furthermore, it is not sufficient for suppressing pseudo contours to control only the barycenter position. The change of the display when an object moves on the screen is show in FIG. 23. FIG. 23 shows a contour portion of an object having P gradation level moving on a background having Q gradation level. When a line of sight follows the movement of the object, the image of the object stays on a retina, and the quantity of entering light on the retina is distributed as shown in FIG. 24. Considering the lighting pattern, the integral quantity of light on the retina becomes as shown in FIG. 25. It is usual that there is a gap between the cells in a real cell arrangement. For example, a partition for defining cells forms a cell gap. In a color display using three color cells, there is a cell of another color between cells of a certain color, so that a gap corresponding to two cells can be generated. Considering this fact, the quantity of entering light on the retina when there is a cell gap is shown in FIG. 25. FIG. 25 shows the integral quantity of light in one frame made of plural subframes (denoted by SF in FIG. 25). Though there is no overlap of light emission profiles between the neighboring cells in FIG. 25, but it is not essential. The presence or absence of the overlap depends on a moving rate of the line of sight and a lighting pattern.

Usually, the observation of the screen is performed in the state where a cell pitch is smaller than the resolution of eyes. Therefore, light quantity profile on the retina shown in FIG. 25 is observed as being averaged in the space direction. In the display error that is a shift from the target light quantity, components having spatial frequencies above the cell pitch are not recognized. Components having spatial frequencies below the cell pitch mainly contributes to the pseudo contour, while the variation of sparse and dense of the space light emission profile corresponds to a dark portion and a bright portion. The variation of sparse and dense of the light emission profile cannot be controlled only by the barycenter of the light emission and is affected by the expansion of the lighting pattern as shown in FIGS. 26 and 27. In FIG. 26, the light emission is concentrated in the middle portion of the projection area of the frame in both of the neighboring cells, so the pseudo contour is not conspicuous. In contrast, though the pattern shown in FIG. 27 has the pattern of the barycenter of the light emission equal to the pattern shown in FIG. 26, the light emission of one of the cells is unevenly distributed to the edge portion of the projection area of the frame. In this case, the variation of sparse and dense of the light emission intensity may occur between the neighboring cells and be observed as a pseudo contour.

As explained above, from the viewpoint of the pseudo contour, the optimal lighting pattern is not always selected only by aligning barycenter positions. In addition, the conventional method in which only the individual cell is noted so as to make the lighting pattern vary little between the present frame and the past frame is not sufficient for reducing flickers and pseudo contours.

Moreover, in the conventional method, it is necessary that a skilled person decide in accordance with experiences which lighting pattern should be selected for each gradation level when making a conversion table that connects a frame with subframes. If the relationship between the previous frame and the present frame is considered as explained above and the gradation number N is supposed to be 256, an optimal lighting pattern must be determined for each of $256^2$ gradation levels with enormous efforts. If two or more previous frames are referred, the combination of the gradation levels becomes up to $N^3$. When the gradation number N is increased or the weight is changed, the change of the specification causes tiresome jobs every time.

SUMMARY OF THE INVENTION

According to the method of the present invention, the lighting pattern of the noted pixel is determined by referring both the lighting pattern in the past frame neighboring in the time scale and the lighting pattern of the neighboring pixel so that flickers and pseudo contours are reduced. More specifically, the lighting pattern is determined so that the sum of the error calculated on the basis of Fourier components of a display error between the noted frame and the neighboring past frame and the error calculated on the basis of Fourier components of a display error between the noted pixel and the neighboring peripheral pixel becomes small. The pixel means a unit display element of a screen (a display element having a single light color).

The display error from the past frame means the difference between the light emission waveform when a frame is divided into subframes for a display and an ideal light emission waveform. Fourier components of this display error are evaluated and the lighting pattern that makes the difference small is selected. On this occasion, since time resolution of eyes of human beings cannot recognize Fourier components having higher orders, weight is given to each order of the Fourier components for evaluating the error. This is effective for reducing flickers.

The display error from the peripheral pixel means the difference between the target light quantity that is expected on the retina when the line of sight moves and a light quantity distribution derived from the integral of the light emission of subframes.

Though the effect can be obtained even if only one peripheral pixel is referred, it is desirable that two or more peripheral pixels are referred. Namely, if only the pixel aligned in one direction of the screen is referred, mixture of lighting patterns when the line of sight moves in the other direction is not taken in consideration. Therefore, it is desirable to refer two or more pixels having different directions of arrangement with respect to the noted pixel. For example, the lighting pattern may be determined by referring the pixel neighboring in the horizontal direction and the pixel neighboring in the vertical direction. However, it is necessary that the lighting pattern of the pixel to be reference must be determined before the reference, so the order of noting pixels is selected so as to satisfy the condition. In the form in which the process is performed in parallel with the input of serial image data, it is natural to determine the lighting pattern in the order of inputting the image data, so as to think about the algorism of the data process easily. The pixel located at the edge of the screen does not have pixels to be referred in part or at all. Concerning such a pixel, an imaginary pixel when all subframes are not lighted may be referred for determining the lighting pattern, or only the pixels that can be referred are referred for determining the lighting pattern.

DESCRIPTION OF THE PREFERRED EMBODIMENTS

Hereinafter, the present invention will be explained more in detail with reference to embodiments and drawings.

Figure 1:
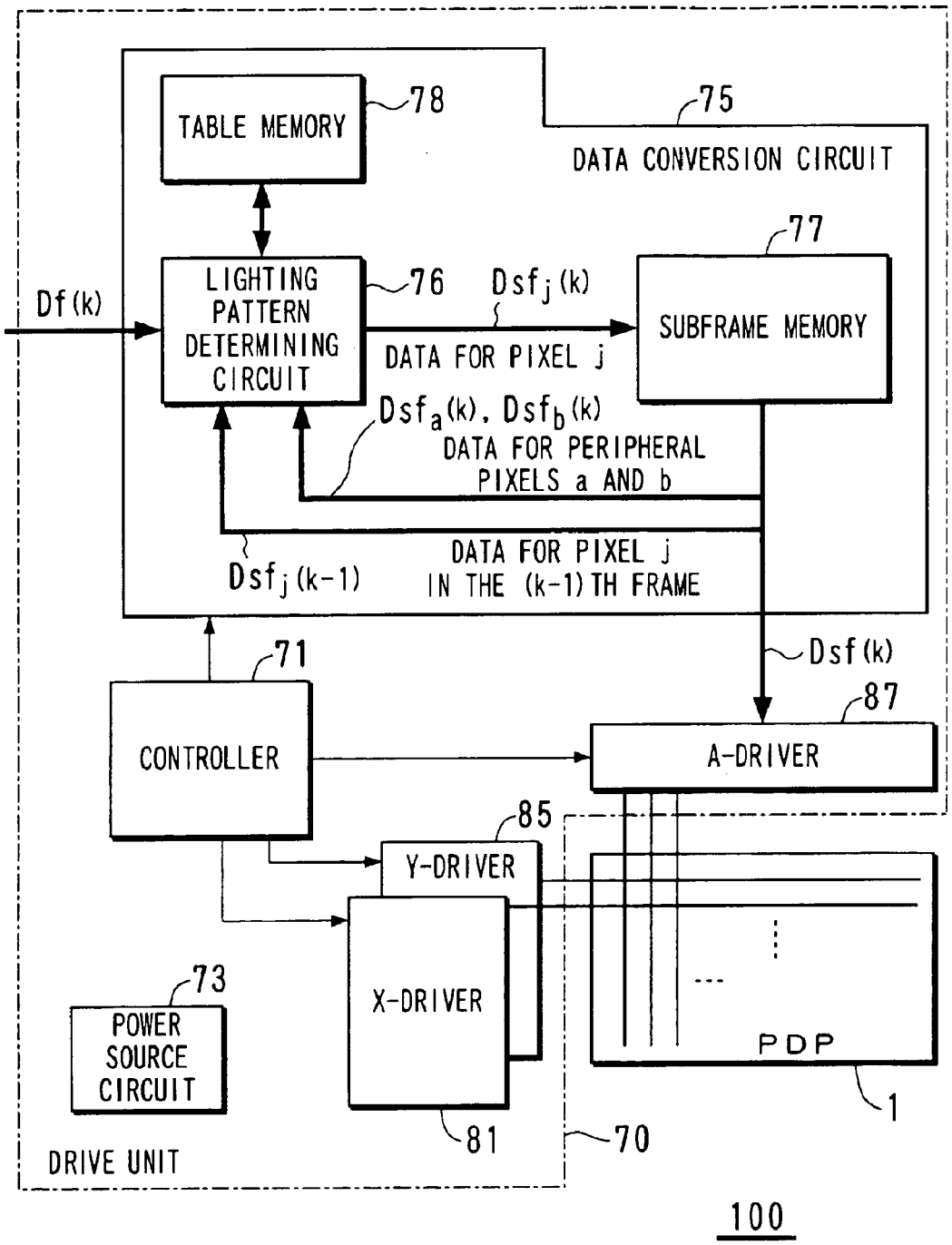
FIG. 1 is a block diagram of a display device according to the present invention.
Figure 2:
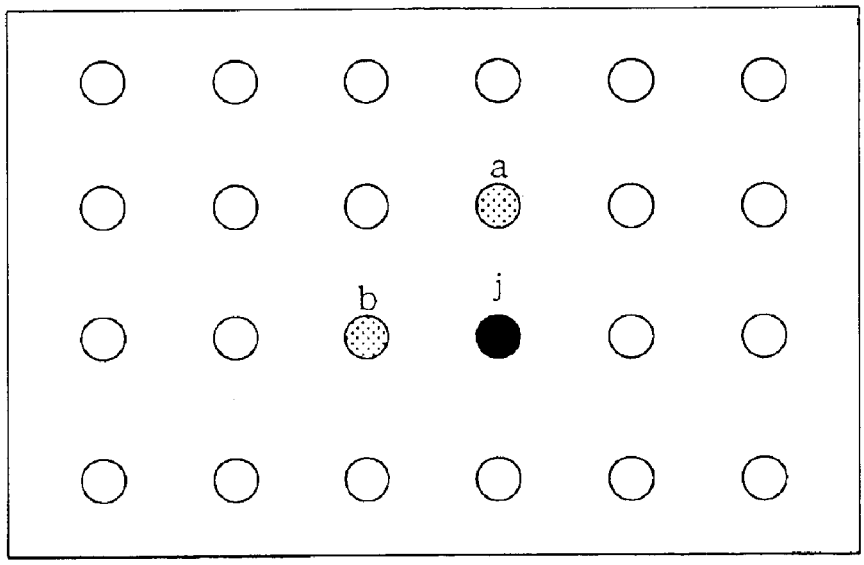
FIG. 2 is a diagram showing the relationship between positions of a noted pixel and peripheral pixels for determining a lighting pattern.
Figure 3:
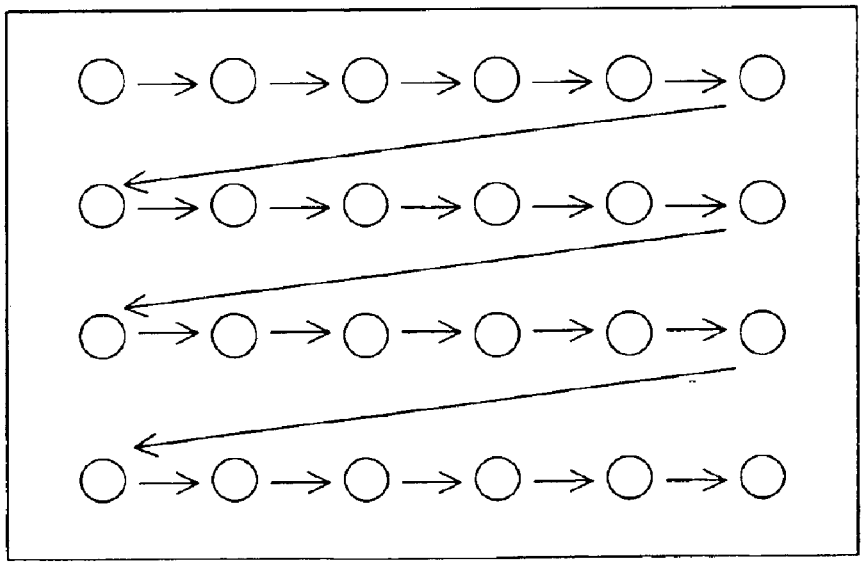
FIG. 3 is a diagram showing an order of determining a lighting pattern in pixels arranged in a square arrangement.

FIG. 1 is a block diagram of a display device according to the present invention. FIG. 2 is a diagram showing the relationship between positions of a noted pixel and peripheral pixels for determining a lighting pattern. FIG. 3 is a diagram showing an order of determining a lighting pattern in pixels arranged in a square arrangement.

The display device 100 comprises a surface discharge type PDP 1 having a display screen including m×n cells and a drive unit 70 for selectively lighting cells arranged in a matrix. The display device 100 is used as a wall-hung television set or a monitor of a computer system.

The PDP 1 includes display electrodes arranged in parallel for forming electrode pairs for generating display discharge and address electrodes arranged so as to cross the display electrodes. The display electrode extends in the row direction (the horizontal direction) of the screen, while the address electrode extends in the column direction (the vertical direction).

The drive unit 70 includes a controller 71, a power source circuit 73, a data conversion circuit 75, an X-driver 81, a Y-driver 85 and an A-driver 87. The drive unit 70 is supplied with frame data Df that are multivalued image data indicating luminance levels of red, green and blue colors together with various synchronizing signals from an external device such as a TV tuner or a computer.

In a display using the PDP 1, a binary lighting control is used for reproducing a gradation, so an original frame of a sequential input image is divided into a predetermined number M of subframes. The data conversion circuit 75 converts the frame data Df into subframe data Dsf for a gradation display and send the subframe data Dsf to the A-driver 87. The subframe data Dsf is a set of display data of M screens, in which each cell corresponds one bit. The value of each bit indicates whether light emission of the cell is necessary or not in the corresponding subframe, more specifically whether address discharge is necessary or not. The data conversion circuit 75 includes a lighting pattern determining circuit 76, a subframe memory 77 for memorizing the subframe data Dsf for at least one frame and a table memory 78 for outputting the subframe data Dsf in a table look up format.

The conversion from the frame data Df(k) to the subframe data Dsf(k) in the k-th frame to be displayed is performed one by one pixel in the order shown in FIG. 3. The letter in parentheses indicates the frame order. When the subframe data $Dsf_j(k)$ of the noted pixel j is determined, subframe data $Dsf_j(k-1)$ of the past frame including at least (k−1)th frame and subframe data $Dsf_a(k)$ and $Dsf_b(k)$ of the k-th frame that were already determined for peripheral pixels a and b that are located in the vicinity of the noted pixel j are inputted to the lighting pattern determining circuit 76 as reference data. The lighting pattern determining circuit 76 reads the subframe data $Dsf_j(k)$ corresponding to a combination of data value of the noted pixel j and a reference data value in the frame data Df(k) of the noted pixel j out of the table memory 78, and the subframe data $Dsf_j(k)$ are written in the subframe memory 77. The data contents of the table memory 78 are set so that the Fourier component of the error with respect to the target value becomes the minimum value. It is possible to replace the table memory 78 with an operational processor, which calculates an optimal subframe expression by Fourier operation responding to an input.

Figure 4:
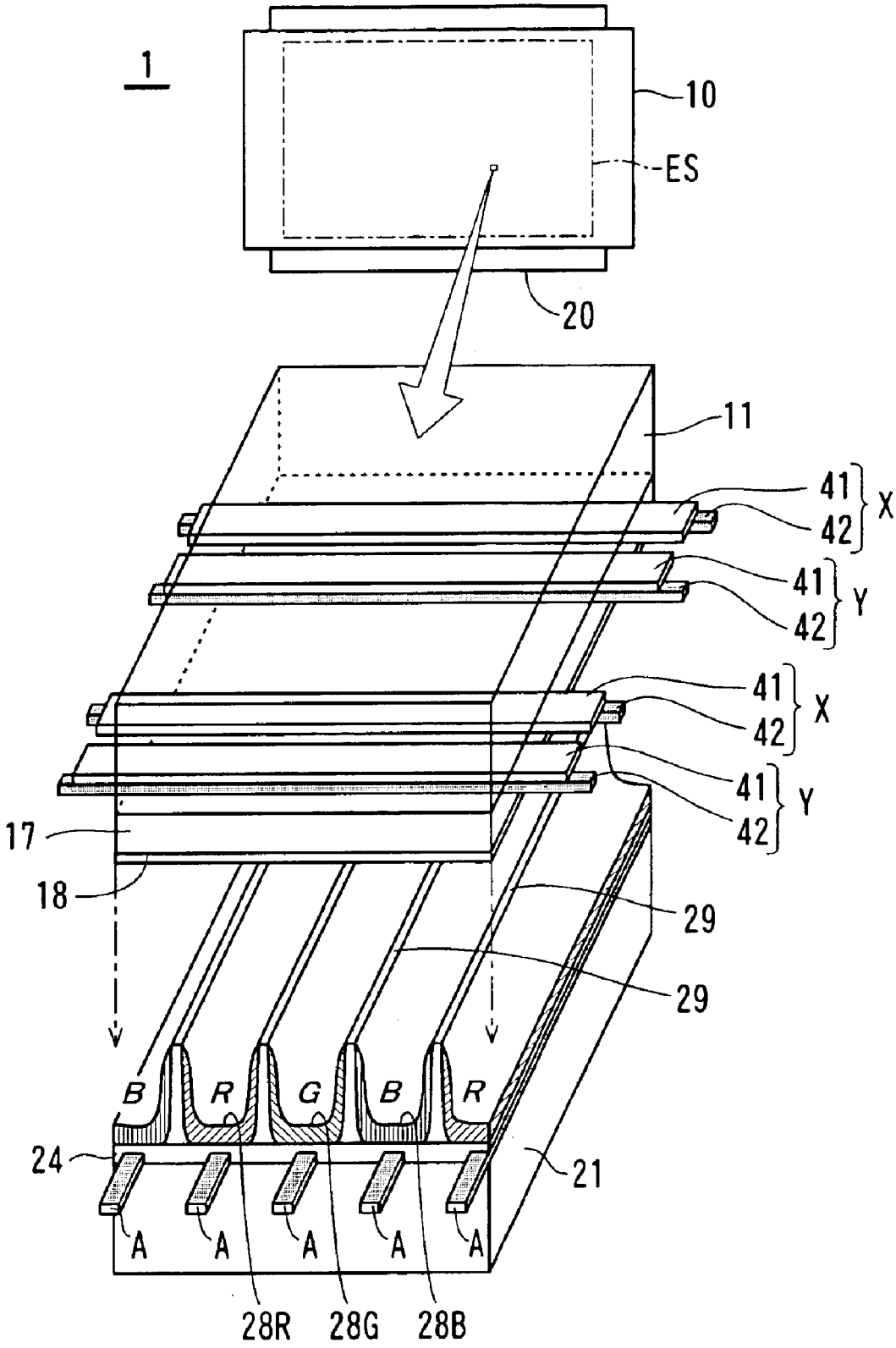
FIG. 4 shows an example of a cell structure of a PDP.

FIG. 4 shows an example of a cell structure of a PDP.

In FIG. 4, the PDP 1 comprises a pair of substrate structures (the structure includes a substrate on which cell elements are disposed) 10 and 20. On the inner surface of the glass substrate 11 that is a base of the front substrate structure 10, display electrodes X and Y are arranged so that a pair of the electrodes X and Y corresponds to one row of the display screen ES having n rows and m columns. The display electrodes X and Y includes a transparent conductive film 41 for forming a surface discharge gap and a metal film 42 that is overlaid on the edge portion of the transparent conductive film 41. The display electrodes X and Y are covered with a dielectric layer 17, which is coated with a protection film 18.

On the inner surface of the back glass substrate 21, address electrodes A are arranged so that an address electrode A corresponds to one column. The address electrodes A are covered with a dielectric layer 24. On the dielectric layer 24, partitions 29 having the height of approximately 150 microns are disposed. A partition pattern is a stripe pattern for dividing a discharge space into plural columns. The surface of the dielectric layer 24 and the side faces of the partitions 29 are covered with fluorescent material layers 28R, 28G and 28B for a color display. Italic letters (R, G, B) in FIG. 4 indicate light emission colors of the fluorescent materials. A color arrangement is a repeating pattern of red, green and blue, in which cells in a column has the same color. In other words, three columns (three cells) in one row correspond to one pixel of a display image. The fluorescent material layers 28R, 28G and 28B are locally excited by ultraviolet rays emitted by a discharge gas so as to emit light.

Figure 5:
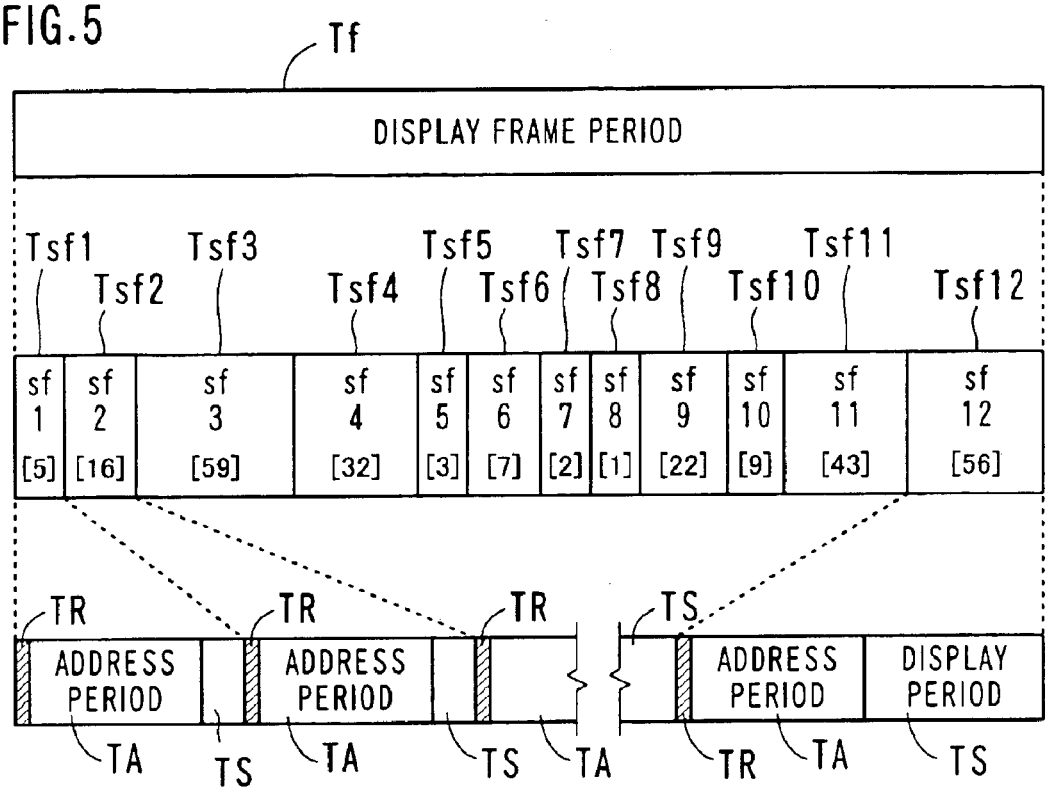
FIG. 5 shows a general concept of frame division.
Figure 6:
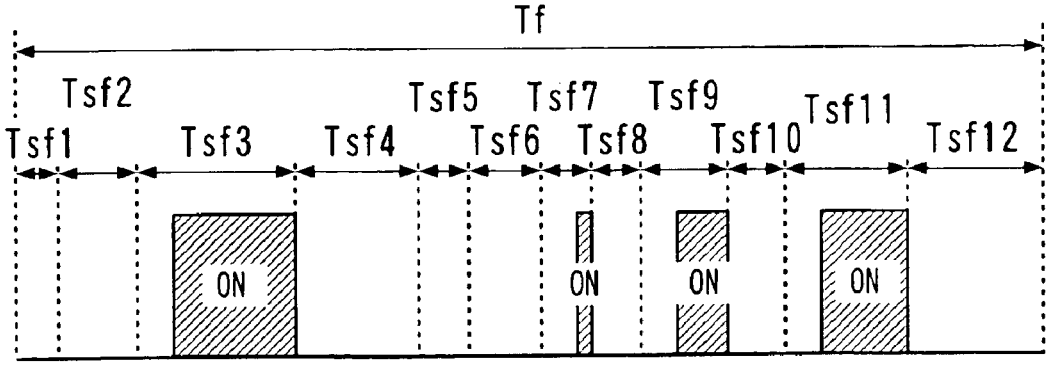
FIG. 6 shows an example of the lighting pattern.

FIG. 5 shows a general concept of frame division. FIG. 6 shows an example of the lighting pattern.

In order to reproduce each color by the individual gradation display, a frame is divided into twelve subframes, for example. Namely, a frame is replaced with twelve subframes sf1–sf12. The ratio of luminance levels of the subframes is set to approximately 5:16:59:32:3:7:2:1:22:9:43:56 by weighting, so that the number of display discharge times in each subframe is set. By combining on and off of each subframe, 256 steps of luminance levels can be set for each color of red, green or blue.

The display frame period Tf is divided into subframes, and subframe periods Tsf1–Tsf12 are assigned to each subframe. Each of the subframe periods Tsf1–Tsf12 is divided into a preparation period TR for equalizing charge distribution in the whole screen, an address period TA for forming a charge distribution corresponding to display contents and a display period TS for sustaining a lighted state for securing a luminance level corresponding to a gradation level. The lengths of the preparation period TR and the address period TA are constant regardless of the luminance weight, while the length of the display period TS is longer as the luminance weight is larger.

As shown in FIG. 6, in a display of the gradation level 126 (=59+2+22+43), the lighting pattern that turns on four subframes sf3, sf7, sf9 and sf11 is selected.

Hereinafter, a data conversion method for optimizing a lighting pattern will be explained.

EXAMPLE 1

One cell is noted. If there is no cell in the referred position, only cells that can be referred are referred.

Figure 7:
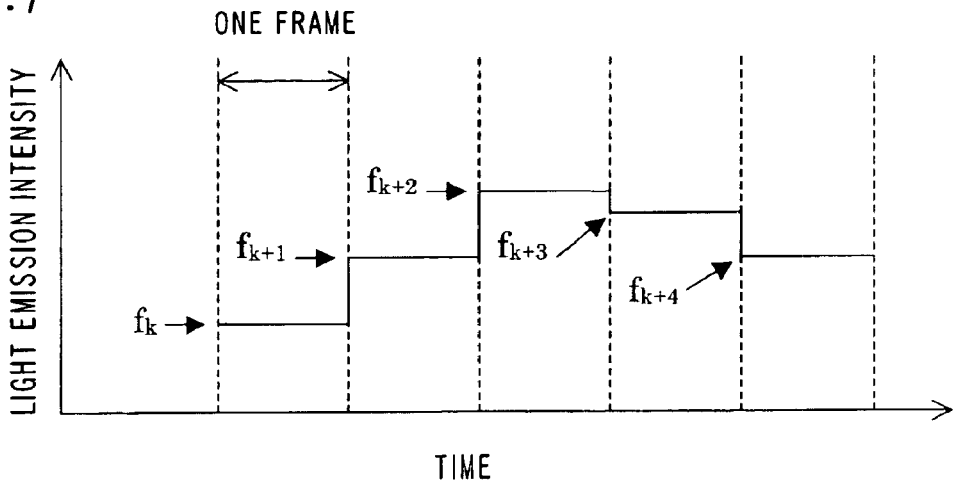
FIG. 7 shows a target light emission waveform.

First, evaluation of Fourier component for reducing flickers will be explained. It is supposed that the luminance level to be displayed is $f_k$. Here, k denotes the number of the frame. The number of the frame whose lighting pattern will be determined is denoted by k, and the number of the previous frame is denoted by k−1. In this case, an ideal light emission waveform is as shown in FIG. 7. The target is set to the state in which the light emission intensity in one frame becomes constant.

Figure 8:
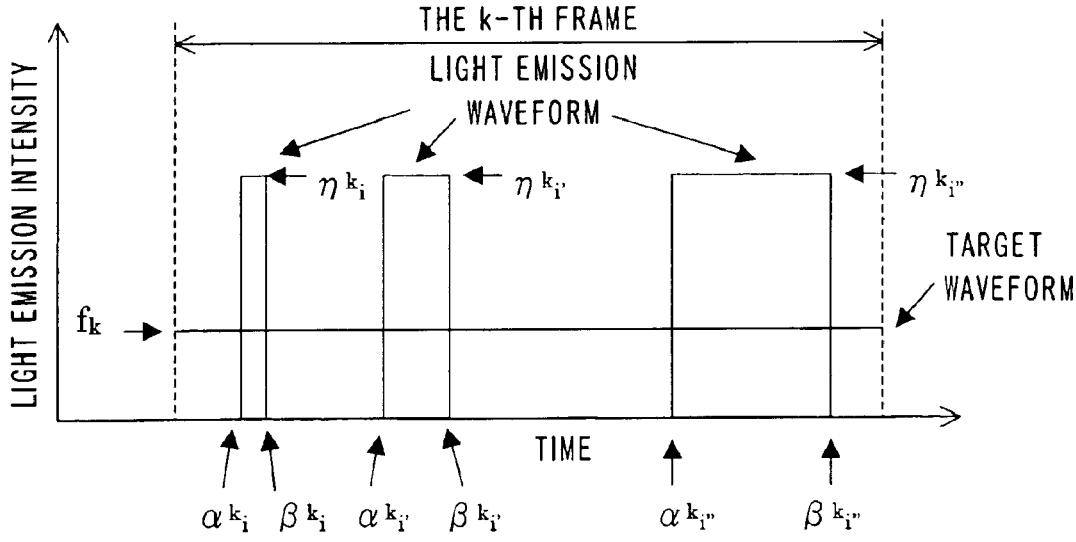
FIG. 8 shows a light emission waveform of one frame and a target light emission waveform.

The light emission intensity of the i-th subframe in the k-th frame is denoted by $\eta^k_i$, the start point of the display period is denoted by $\alpha^k_i$, and the end point of the display period is denoted by $\beta^k_i$ (see FIG. 8). The unit of the time scale is the frame period, and origins of $\alpha^k_i$ and $\beta^k_i$ are set to the head of the k-th frame. Concerning $\eta^k_i$, every frame has the same subframe structure, and the luminance level when the i-th subframe is lighted by itself is denoted by $f_{SF}{}^k{}_i$. Then the following equation is used for normalization.

$$f_{SF}{}^k{}_i=\eta^k_i(\beta^k_i-\alpha^k_i) \tag{1}$$

If the period of the display discharge is not changed for every subframe, $\eta^k_i$ also has a substantially constant value regardless of the subframe. The subframe structure can be different for each frame.

The expansion into Fourier series is performed in the period of two sequential frames, i.e., the k-th frame and the (k−1)th frame. The coordinate in the time axis when the unit is the frame period is denoted by t, the origin of the coordinate is set to the head of the k-th frame, and the basis function system is set as shown in the following expression.

$$\left\{\frac{1}{2}, \cos(n\pi t), \sin(n\pi t)\right\} \tag{2}$$

The lighting pattern of the subframe in the k-th frame is determined so that an error of the light emission waveform from the target waveform becomes small. Then, the error is evaluated by Fourier expansion of the difference between the light emission waveform and the target waveform.

Supposing that the light emission waveform is $\phi(t)$ and the target light emission waveform is f(t), the Fourier expansion of the error in two frame periods of the (k−1)th frame and the k-th frame is given as follows.

$$\phi(t) - f(t) = \frac{a_0}{2} + \sum_{n=1}^{\infty}(a_n\cos(n\pi t) + b_n\sin(n\pi t)) \tag{3}$$

Here, the coefficients are defined as follows.

$$a_n = \int_{-1}^{1}(\phi(t) - f(t))\cos(n\pi t)dt \quad (n = 0, 1, 2, \dots) \tag{4}$$

$$b_n = \int_{-1}^{1}(\phi(t) - f(t))\sin(n\pi t)dt \quad (n = 1, 2, \dots)$$

Next, it is supposed that the light emission waveform is $\phi^k(t)$ and the target light emission waveform is $f^k(t)$ when the coordinate origin is set to the head of each frame. The letter k denotes the number of the frame. In this case, the following integral is defined for each frame.

$$a^k_n = \int_{0}^{1}(\phi^k(t) - f^k(t))\cos(n\pi t)dt \quad (n = 0, 1, 2, \dots) \tag{5}$$

$$b^k_n = \int_{0}^{1}(\phi^k(t) - f^k(t))\sin(n\pi t)dt \quad (n = 1, 2, \dots)$$

Using the equations (5), the coefficients defined by the equations (4) can be rewritten as follows.

$$a_n=a^k{}_n+(-1)^n a^{k-1}{}_n$$

$$b_n=b^k{}_n+(-1)^n b^{k-1}{}_n \tag{6}$$

Next, the integral shown in the equation (5) will be calculated.

First, the lighting pattern of the subframe in the k-th frame is denoted by $\delta^k(i)$. When the i-th subframe is lighted, $\delta^k(i)=1$, while $\delta^k(i)=0$ when the i-th subframe is not lighted. In addition, a function having the value one only in the period from $\alpha$ to $\beta$ and the value zero in the other periods is defined by $S(t;\alpha, \beta)$, $\phi^k(t)$ in the k-th frame period can be written as follows.

$$\phi^k(t) = \sum_{i=1}^{M_k}\delta^k(i)\eta^k_i S(t; \alpha^k_i, \beta^k_i) \tag{7}$$

Here, the letter $M_k$ denotes the total number of the subframes in the k-th frame.

On the other hand, $f^k(t)$ in the k-th frame period is expressed as follows.

$$f^k(t)=f_k \tag{8}$$

Thus, the following equations are derived.

$$a^k_0 = \sum_{i=1}^{M_k}\delta^k(i)f^k_{SF^i} - f_k \tag{9}$$

$$a^k_n = \left(\frac{1}{n\pi}\right)\sum_{i=1}^{M_k}\delta^k(i)\eta^k_i(\sin(n\pi\beta^k_i) - \sin(n\pi\alpha^k_i)) \quad (n = 1, 2, \dots)$$

$$b^k_n = -\left(\frac{1}{n\pi}\right)\sum_{i=1}^{M_k}\delta^k(i)\eta^k_i(\cos(n\pi\beta^k_i) - \cos(n\pi\alpha^k_i)) + \left(\frac{1}{n\pi}\right)f_k((-1)^n - 1) \quad (n = 1, 2, \dots)$$

From these equations and the equation (6), the Fourier coefficient can be obtained. If the display device has the gradation number capable of expressing the gradation number of an input signal, $a^k_n$ and $b^k_n$ are determined by the lighting pattern. Therefore, a conversion table can be made in advance.

Next, the error of the light emission distribution that can be sensed by eyes of a human being will be considered. When the sensitivity of eyes of a human being (or a quantity proportional to the sensitivity) to frequencies of the Fourier components is denoted by $\xi_n$, the error with weight of the light emission waveform within the two frames that can be sensed by eyes of a human being is expressed by the following equation using the weight $\xi_n$.

$$E_h(t) = \xi_0\left(\frac{a_0}{2}\right) + \sum_{n=1}^{\infty} \xi_n(a_n\cos(n\pi t) + b_n\sin(n\pi t)) \tag{10}$$

The root-mean-square value of this error within the two frames is calculated as follows.

$$E_p^k = \sqrt{(\xi_0)^2\left(\frac{a_0}{2}\right)^2 + \sum_{n=1}^{\infty} (\xi_n)^2((a_n)^2 + (b_n)^2)} \tag{11}$$

Usually, the frame frequency is set to a frequency at which flickers are not sensed. Namely, since the sensitivity of eyes to the components above frame frequency is very bad, the approximation of the equation (11) can be performed as follows.

$$E_p^k = \sqrt{(\xi_0)^2\left(\frac{a_0}{2}\right)^2 + (\xi_1)^2((a_1)^2 + (b_1)^2)} \tag{12}$$

Here, if the display device is capable of expressing the gradation number of an input signal and the display is performed faithfully to the gradation of the input signal, $a_0=0$, and the equation (12) can be rewritten as follows.

$$E^k_p=\sqrt{(a_1)^2+(b_1)^2} \tag{13}$$

The weight is meaningless in the equation (13) when the lighting pattern is selected, so it is omitted. The letter p denotes the number of the cell under consideration.

Next, the Fourier component of the display error of the noted cell from the neighboring cells in the frame that is projected onto the retina in the space direction when the line of sight moves will be explained. The movement of the line of sight is not limited to the case where the movement of an object is followed, but can be the case where a gazed point on the screen moves.

Figure 9A:
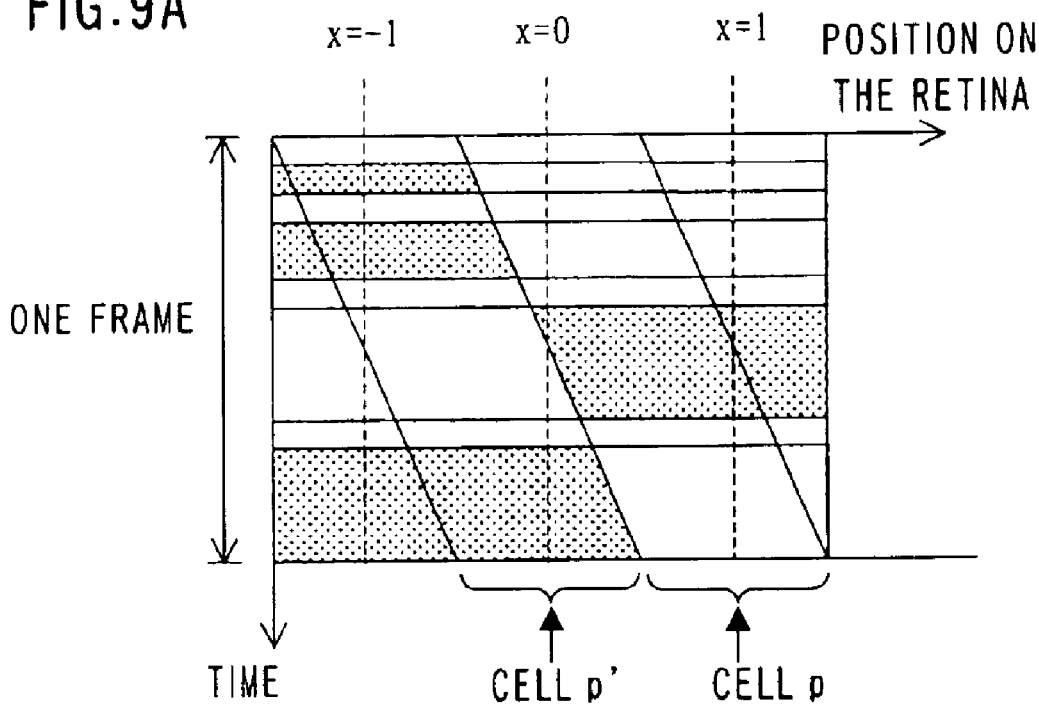
FIGS. 9A and 9B show the relationship between moving direction of the line of sight and the variation of the quantity of light entering in the retina.
Figure 9B:
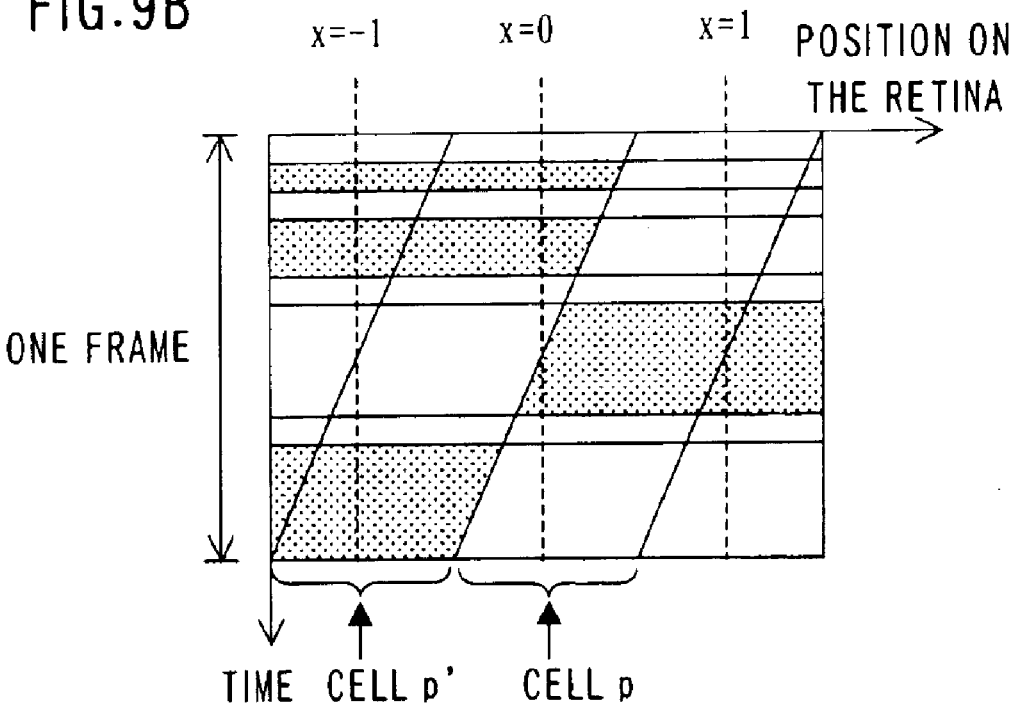

The frame under consideration is the k-th frame. The suffix for indicating the frame is omitted. The luminance level to be displayed is denoted by $f_p$. Here, the letter p is the number of a cell. In a color display, cells having the same color are considered. There are two types of method for mixing the lighting patterns depending on the movement direction of the line of sight as shown in FIG. 9A and FIG. 9B. A movement speed of the line of sight is denoted by U, and the direction is considered to be positive in the case shown in FIG. 9A. The movement speed of the line of sight is expressed by the number of cells per frame.

The coordinate on the retina is denoted by x, and a cell pitch in the movement direction of the line of sight is used as a unit. Then, the cell whose lighting pattern is being determined is denoted by p, and the cell that will be referred is denoted by p'. It is supposed that the center coordinate x of the image of the cell p projected onto the retina is ½, and the center coordinate x of the image of the cell p' projected onto the retina is −½. In addition, cell width in the movement direction of the line of sight is used as a cell pitch unit W. In a cell having an RGB stripe structure, W is equal to ⅓ when the line of sight moves in the horizontal direction, while W is equal to one when the line of sight moves in the vertical direction.

The projected image $\phi'^p_i(x)$ of the cell p in the i-th subframe is expressed by the following equation.

$$\phi_i'^p(x) = \int_{\alpha_i}^{\beta_i} \frac{\eta_i}{W} S\left(x; \lambda U + \frac{1}{2}(1 - U - W), \lambda U + \frac{1}{2}(1 - U - W)\right) d\lambda \tag{14}$$

When the lighting pattern of the cell p is denoted by $\delta^p(i)$, the projected image $\phi'^p(x)$ of the cell p is expressed by the following equation.

$$\phi'^p(x) = \sum_{i=1}^{M} \delta^p(i)\phi_i'^p(x) \tag{15}$$

Figure 27:
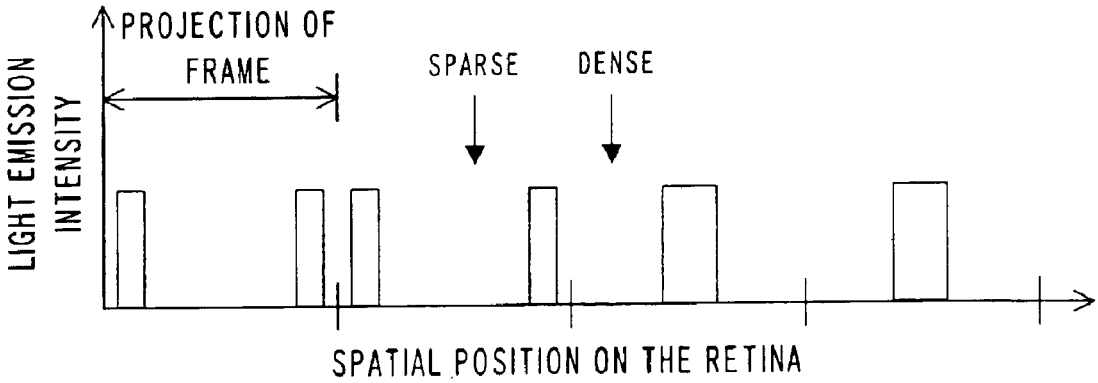
FIG. 27 shows a combination of lighting patterns in which pseudo contours are conspicuous.

The pseudo contour is generated by the variation of sparse and dense of the light emission distribution as shown in FIG. 27. This variation of sparse and dense corresponds to the component of the double period of the cell pitch in the Fourier expansion of the distribution when the lighting patterns of two neighboring cells are arranged alternately and repeatedly. However, since the component of the double period of the cell pitch due to the difference between the gradation levels of the cells is not related to the variation of sparse and dense, the portion thereof is omitted. Namely, it is sufficient to evaluate the Fourier component of the difference between the light emission distribution and the target light emission distribution.

Similarly to the case where the flickers are evaluated, the basis function system over the cell p whose lighting pattern is being determined and the cell p' to be referred is defined as follows.

$$\left\{\frac{1}{2}, \cos(n\pi x), \sin(n\pi x)\right\} \tag{16}$$

Under this basis function system, the difference between the light emission distribution $\phi'(x)$ and the target light emission distribution $f'(x)$ is processed by the Fourier expansion as follows.

$$\phi'(x) - f'(x) = \frac{a_0'}{2} + \sum_{n=1}^{\infty} (a_n'\cos(n\pi x) + b_n'\sin(n\pi x)) \tag{17}$$

Here, the coefficients are defined by the following equations.

$$a_n' = \int_{-1}^{1} (\phi'(x) - f'(x))\cos(n\pi x)dx \quad (n = 0, 1, 2, \ldots) \tag{18}$$

$$b_n' = \int_{-1}^{1} (\phi'(x) - f'(x))\sin(n\pi x)dx \quad (n = 1, 2, \ldots)$$

The light emission distribution $\phi'(x)$ when the lighting patterns of the cell p and the cell p' are arranged alternately one by one cell can be expressed as follows.

$$\phi'(x) = \sum_{j=-\infty}^{\infty} \{\phi'^p(x - 2j) + \phi'^{p'}(x - 2j + 1)\} \quad (-1 \le x \le 1) \tag{19}$$

Therefore, the integral of each lighting pattern is defined as follows.

$$a'^{p}_{n} = \int_{-1}^{1} \sum_{j=-\infty}^{\infty} \phi'^{p}(x-2j)\cos(n\pi x)dx - \int_{0}^{1} f'(x)\cos(n\pi x)dx \quad (n = 0, 1, 2, \ldots) \tag{20}$$

$$b'^{p}_{n} = \int_{-1}^{1} \sum_{j=-\infty}^{\infty} \phi'^{p}(x-2j)\sin(n\pi x)dx - \int_{0}^{1} f'(x)\sin(n\pi x)dx \quad (n = 1, 2, \ldots)$$

Then, the coefficient in the equation (18) can be written as below.

$$a'_n = a'^{p}_{n} + (-1)^n a'^{p'}_{n}$$
$$b'_n = b'^{p}_{n} + (-1)^n b'^{p'}_{n} \tag{21}$$

When the target light emission intensity of the cell p is denoted by $f'_p$, the following equation is satisfied in the period of the cell p.

$$f'(x) = f'_p (0 \leqq x \leqq 1) \tag{22}$$

When performing the integral of the equation (20), the following equations are derived.

$$a'^{p}_{0} = \sum_{i=1}^{M} \delta^{p}(i) f_{SFi} - f'^{p} \tag{23}$$

$$a'^{p}_{n} = \sum_{i=1}^{M} \delta^{p}(i)\left(\frac{\eta_i}{UW}\right)\left(\frac{1}{n\pi}\right)^2 \left[-\cos\left(n\pi\left(\beta_i U + \frac{1}{2}(1-U+W)\right)\right) + \cos\left(n\pi\left(\beta_i U + \frac{1}{2}(1-U-W)\right)\right) + \cos\left(n\pi\left(\alpha_i U + \frac{1}{2}(1-U+W)\right)\right) - \cos\left(n\pi\left(\alpha_i U + \frac{1}{2}(1-U-W)\right)\right)\right]$$

$$b'^{p}_{n} = \sum_{i=1}^{M} \delta^{p}(i)\left(\frac{\eta_i}{UW}\right)\left(\frac{1}{n\pi}\right)^2 \left[-\sin\left(n\pi\left(\beta_i U + \frac{1}{2}(1-U+W)\right)\right) + \sin\left(n\pi\left(\beta_i U + \frac{1}{2}(1-U-W)\right)\right) + \sin\left(n\pi\left(\alpha_i U + \frac{1}{2}(1-U+W)\right)\right) - \sin\left(n\pi\left(\alpha_i U + \frac{1}{2}(1-U-W)\right)\right)\right] + \left(\frac{1}{n\pi}\right) f'^{p}((-1)^n - 1)$$

$$(n = 1, 2, \ldots)$$

If the preset gradation level of the cell is equal to the target gradation level, $a'^{p}_{0}$ is equal to zero. If the display device has a gradation number capable of expressing the gradation number of an input signal, $a'^{p}_{n}$ and $b'^{p}_{n}$ are determined by the lighting pattern, so that the conversion table can be prepared in advance.

Since the component having the double period of the cell pitch corresponds to the case of n=1, the variation of sparse and dense of the light emission distribution can be evaluated by the following equation.

$$E'^{k}_{pp'} = \sqrt{(a'_1)^2 + (b'_1)^2} \tag{24}$$

This value does not depend on the sign of U.

It is supposed that the reference cell in the horizontal direction is denoted by p' and the reference cell in the vertical direction is denoted by p". Supposing that the error between the flicker components in the k-th frame and the (k−1)th frame of the cell p is given by the equation (13), the lighting pattern of the cell p is determined so that Es given by the following equation becomes the minimum value.

$$E_s = \zeta E^{k}_{p} + \zeta' E'^{k}_{pp'} + \zeta'' E'^{k}_{pp''} \tag{25}$$

Here, ζ, ζ', and ζ" denote weights. The weight is changed depending on which of the flicker and the pseudo contour is more important. The right-hand side of the equation (25) is a function of the lighting pattern of the cell p in the (k−1)th frame and the lighting pattern of the cells p, p' and p" in the k-th frame. The lighting patterns are determined in the order shown in FIG. 3, so that when the lighting pattern of the cell p in the k-th frame is determined, the other lighting patterns are already determined.

The movement speed U of the line of sight depends on the circumstances and the value of $E_s$ also depends on the value of U. In a typical case, the value of $E_s$ when U is equal to two (i.e., the movement speed of the line of sight corresponds to two cells per frame) is evaluated for determining the lighting pattern. The left neighboring cell and the upper neighboring cell are referred as shown in FIG. 2.

The comparison of the flickers as well as the pseudo contours is performed between the two cases; in the first case the lighting pattern is determined in advance so that the position of the barycenter is aligned as much as possible (i.e., a barycenter fixing method), and in the second case the lighting pattern is determined by the method according to the present invention.

It is supposed that the following equation is satisfied.

$$\zeta' = \zeta'' = (1-\zeta)/2 \tag{26}$$

Here, the subframe arrangement is {48, 48, 1, 2, 4, 8, 16, 32, 48, 48 }.

Figure 10:
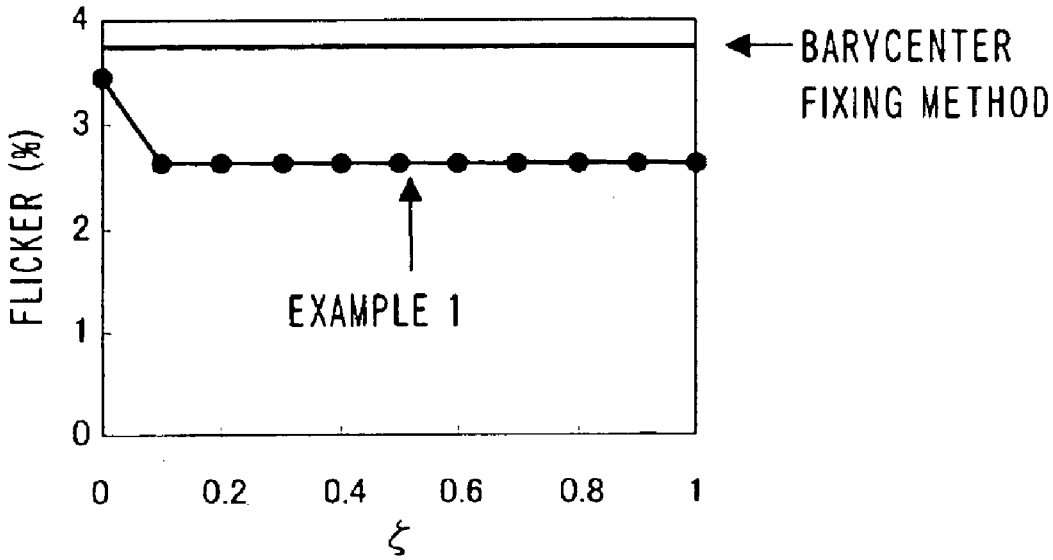
FIG. 10 shows the relationship between weight setting and the flickers in a first example.

The flicker is evaluated by the two-frame period component when the display having r gradation level and the display having r−1 gradation level are repeated one by one frame, i.e., value of the equation (13). The gradation level is used for normalization, so that the average value of 255 cases where r=1 through r=255 is calculated. The result is shown in FIG. 10. As a reference, the barycenter fixing method is shown in FIG. 10. It is understood that the present invention has the effect despite of the value of ζ.

Figure 11:
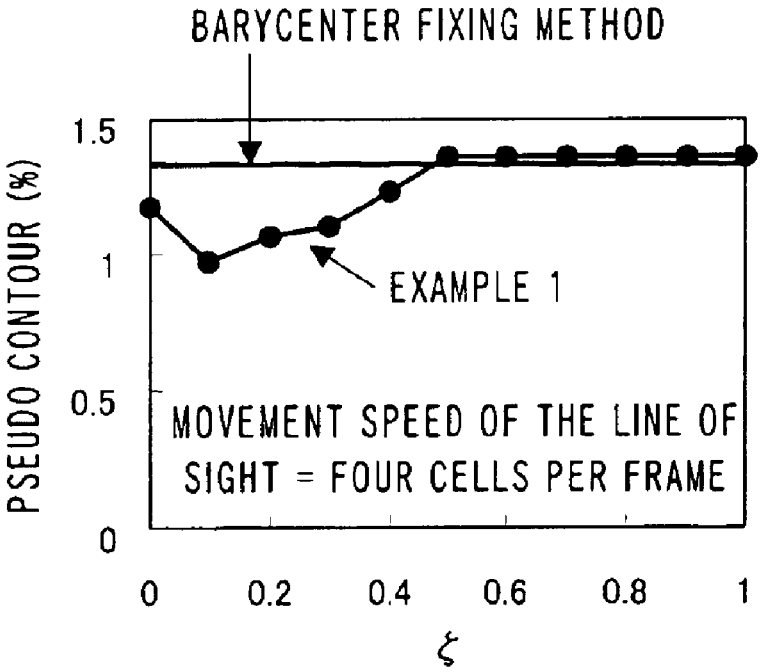
FIG. 11 shows the relationship between the weight setting and a pseudo contour in the first example.

Next, the pseudo contour will be evaluated. The pseudo contour is evaluated in the case where a vertical band having r gradation level and a vertical band having r−1 gradation level are displayed side by side and are scrolled in the horizontal direction, as well as in the case where a horizontal band having r gradation level and a horizontal band having r−1 gradation level are displayed in neighboring manner and are scrolled in the vertical direction. In each of the cases, the maximum value of the error from the target light emission level is normalized by the average gradation level. The average of all cases where r=1 through r=255 is calculated. Approximation of the spatial frequency characteristics of eyes is performed with Butterworth characteristics (a low pass filter) having the cut off frequency of 11 c/deg and the order of 3.3. It is supposed that the observation is performed under the condition where the period of the cell pitch is 50 c/deg. The effect of reducing the pseudo contours to the weight $\zeta$ is shown in FIG. 11. This is the case where the scrolling speed is 4 cells per frame. It is understood that the present invention has the effect also in reducing the pseudo contours. It is understood from FIG. 11 that the effect of reducing the pseudo contours can be obtained in the area where $\zeta$ is below 0.4. The case where $\zeta$ is equal to zero corresponds to the case where only the lighting pattern of the neighboring cell is referred for determining the lighting pattern. As understood from FIGS. 10 and 11, it is more effective in reducing flickers and pseudo contours to refer also the lighting pattern of the past frame than in the case where it is not referred.

Figure 12:
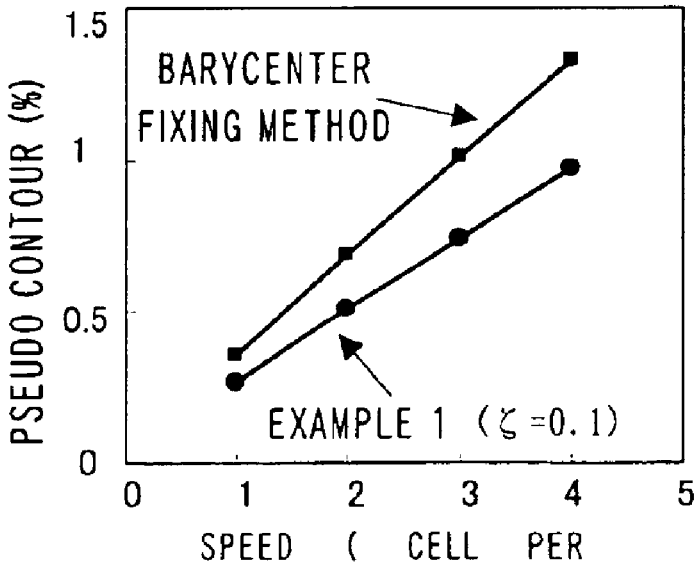
FIG. 12 shows the relationship between movement speed of the line of sight and the pseudo contour in the first example.

The effect of the reduction to the movement speed of the line of sight (i.e., the scrolling speed) is shown in FIG. 12. The evaluation of the equation (25) when determining the lighting pattern is performed under the condition where the scrolling speed is two cells per frame. However, the effect of the reduction can be obtained regardless of the scrolling speed.

Though a display using a PDP is illustrated, the present invention can be effectively applied to other displays (e.g., an organic EL) that utilize the subframe technique.

EXAMPLE 2

Though Fourier component is evaluated for determining the lighting pattern in the first example, it is possible to determine the lighting pattern so as to be similar to the lighting pattern of the reference pixel as much as possible. Considering the case where the subframe structure is constant regardless of the frame, the equation (13) can be rewritten as follows using the equation (9).

$$(E_p^k)^2 = \left(\frac{1}{\pi}\right)^2 \left[ \left\{ \sum_{i=1}^{M_k} (\delta^k(i) - \delta^{k-1}(i)) \eta_i^k (\sin(\pi\beta_i^k) - \sin(\pi\alpha_i^k)) \right\}^2 + \left\{ \sum_{i=1}^{M_k} (\delta^k(i) - \delta^{k-1}(i)) \eta_i^k (\cos(\pi\beta_i^k) - \cos(\pi\alpha_i^k)) + 2(f_k - f_{k-1}) \right\}^2 \right] \tag{27}$$

Furthermore, the equation (24) can be rewritten as follows using the equation (23).

$$(E_{pp'}^{rk})^2 = \left(\frac{1}{UW}\right)^2 \left(\frac{1}{\pi}\right)^4 \left[ \left\{ \sum_{i=1}^{M} (\delta^p(i) - \delta^{p'}(i)) \eta_i C_w \right\}^2 + \left\{ \sum_{i=1}^{M} (\delta^p(i) - \delta^{p'}(i)) \eta_i S_w - 2(f'^p - f'^{p'}) \right\}^2 \right] \tag{28}$$

Here, the following equations are satisfied.

$$\begin{aligned} C_w = &-\cos\left(\pi\left(\beta_i U + \frac{1}{2}(1 - U + W)\right)\right) + \\ &\cos\left(\pi\left(\beta_i U + \frac{1}{2}(1 - U - W)\right)\right) + \\ &\cos\left(\pi\left(\alpha_i U + \frac{1}{2}(1 - U + W)\right)\right) - \\ &\cos\left(\pi\left(\alpha_i U + \frac{1}{2}(1 - U - W)\right)\right) \end{aligned} \tag{29}$$

-continued $$\begin{aligned} S_w = &-\sin\left(\pi\left(\beta_i U + \frac{1}{2}(1 - U + W)\right)\right) + \\ &\sin\left(\pi\left(\beta_i U + \frac{1}{2}(1 - U - W)\right)\right) + \\ &\sin\left(\pi\left(\alpha_i U + \frac{1}{2}(1 - U + W)\right)\right) - \\ &\sin\left(\pi\left(\alpha_i U + \frac{1}{2}(1 - U - W)\right)\right) \end{aligned}$$

$\delta^k(i)$ and $\delta^p(i)$ denote the lighting patterns. Approximately, the closer to the lighting pattern of the past frame is, the smaller the value of the equation (27) is. The closer to the lighting pattern of the neighboring cell is, the smaller the value of the equation (28) is.

Therefore, a simplified method is possible in which the lighting pattern is determined so that the following equation has the minimum value, instead of evaluating the equation (25).

$$E_S' = \zeta \left\{ \sum_{i=1}^{M} |\delta^k(i) - \delta^{k-1}(i)| \eta_i \right\} + \zeta' \left\{ \sum_{i=1}^{M} |\delta^p(i) - \delta^{p'}(i)| \eta_i \right\} + \zeta'' \left\{ \sum_{i=1}^{M} |\delta^p(i) - \delta^{p''}(i)| \eta_i \right\} \tag{30}$$

The equation (30) indicates the sum with weight of absolute value of components of difference vectors between the reference cell and the cell whose lighting pattern is to be determined when lighting pattern is regarded as a vector.

In other words, the equation (30) indicates the sum of distances of the lighting pattern between the reference cell and the cell whose lighting pattern is to be determined when the lighting pattern is regarded as a coordinate value.

Figure 13:
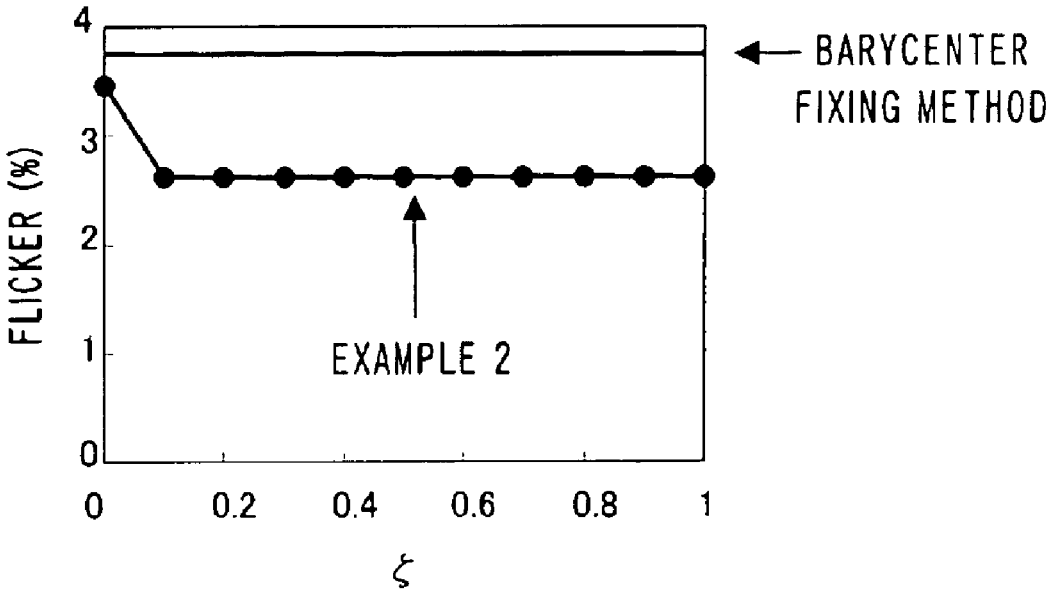
FIG. 13 shows the relationship between the weight setting and the flickers in a second example.
Figure 14:
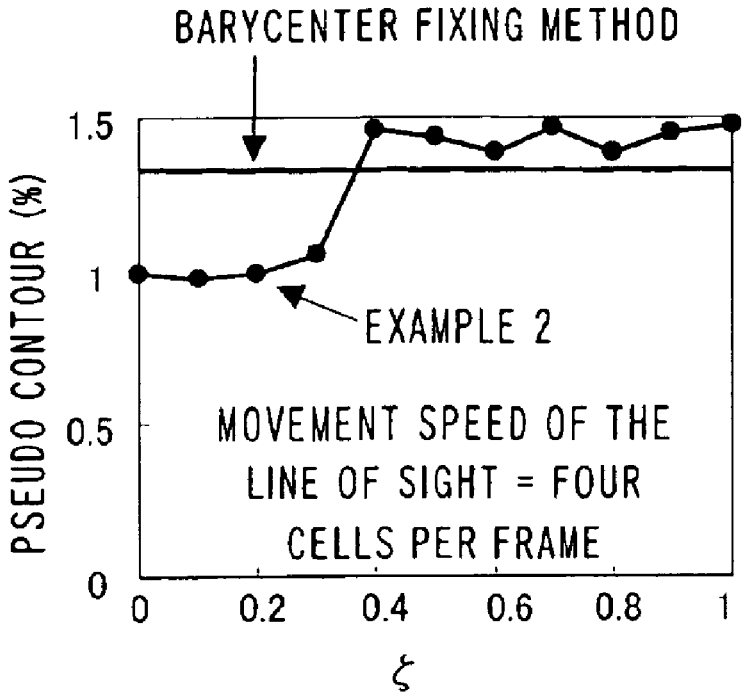
FIG. 14 shows the relationship between the weight setting and the pseudo contour in the second example.
Figure 15:
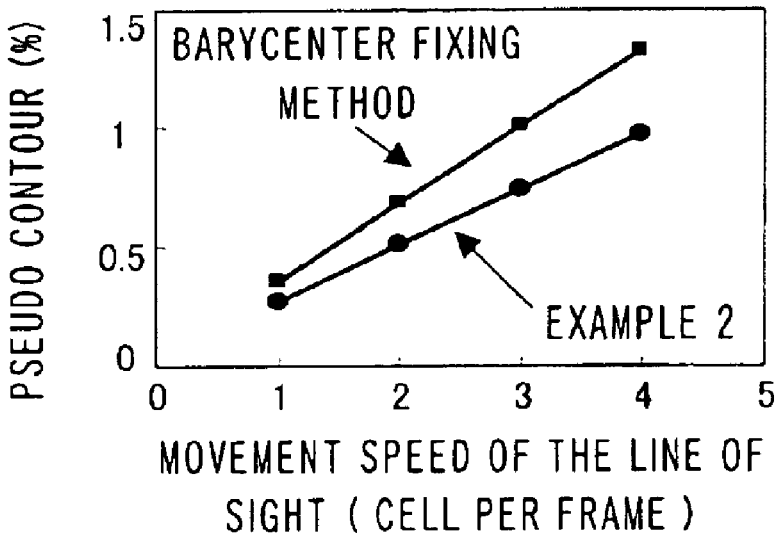
FIG. 15 shows the relationship between the movement speed of the line of sight and the pseudo contour in the second example.

The effects are shown in FIG. 13, FIG. 14 and FIG. 15. It is understood to have the effect equal to the first example.

EXAMPLE 3

There is another method in which the sum of the equation (30) is calculated only for the subframes having a long light emission time by further simplifying the second example. The following equation is evaluated in which a set of the numbers of the selected subframes having a long light emission time is denoted by $\sigma$.

$$E_S'' = \zeta \left\{ \sum_{i \in \sigma} |\delta^k(i) - \delta^{k-1}(i)| \eta_i \right\} + \zeta' \left\{ \sum_{i \in \sigma} |\delta^p(i) - \delta^{p'}(i)| \eta_i \right\} + \zeta'' \left\{ \sum_{i \in \sigma} |\delta^p(i) - \delta^{p''}(i)| \eta_i \right\} \tag{31}$$

Namely, in the method, a combination of on and off of some subframes of one frame (a partial lighting pattern) is noted for determining the lighting pattern.

Figure 16:
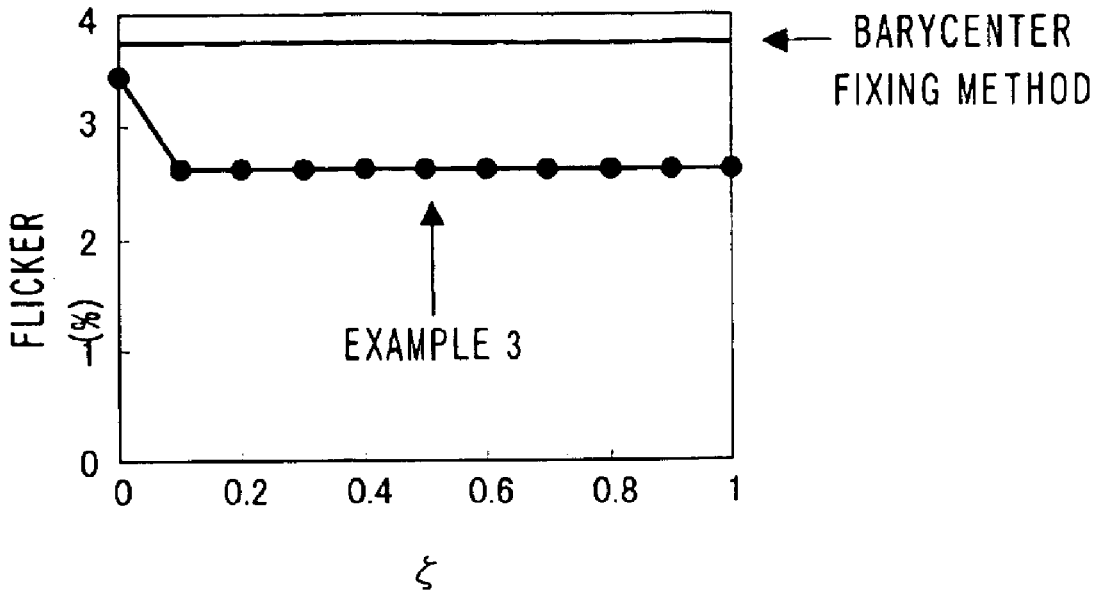
FIG. 16 shows the relationship between the weight setting and the flickers in a third example.
Figure 17:
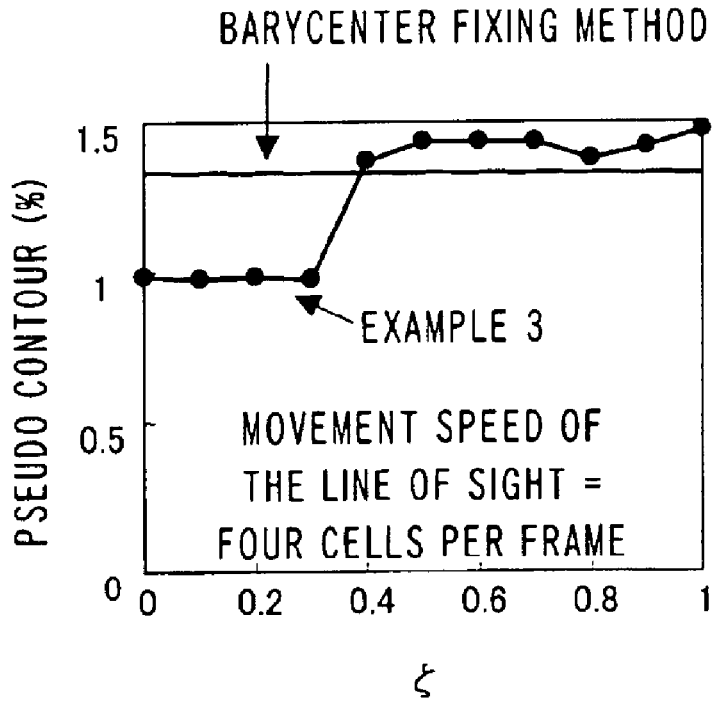
FIG. 17 shows the relationship between the weight setting and the pseudo contour in the third example.
Figure 18:
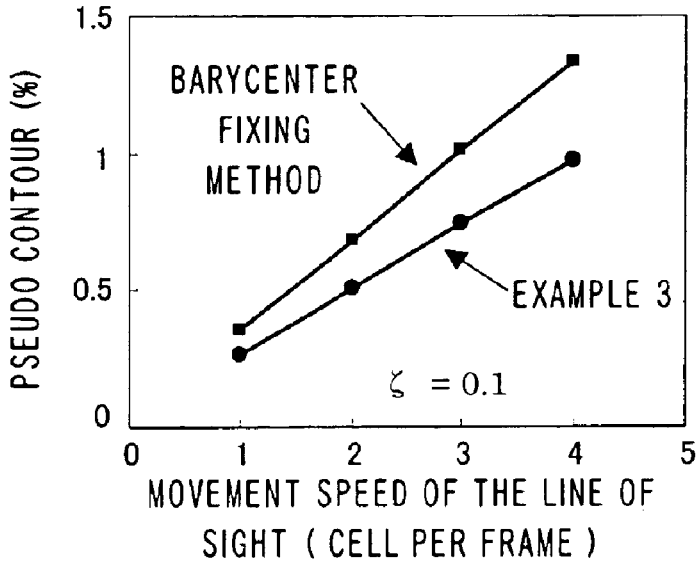
FIG. 18 shows the relationship between the movement speed of the line of sight and the pseudo contour in the third example.

The effects when the partial lighting pattern of five upper subframes is considered are shown in FIGS. 16, 17 and 18. It is understood that the effect of this example is substantially equal to the effect of the first example. The partial lighting pattern can be different in each lighting pattern to be referred.

EXAMPLE 4

There is another method in which the approximation of the equation (31) is further performed so that the evaluation of the weights of subframes is omitted and the evaluation of the following equation is performed.

$$E_S''' = \zeta\left\{\sum_{i\in\sigma}\left|\delta^k(i) - \delta^{k-1}(i)\right|\right\} + \zeta'\left\{\sum_{i\in\sigma}\left|\delta^p(i) - \delta^{p'}(i)\right|\right\} + \zeta''\left\{\sum_{i\in\sigma}\left|\delta^p(i) - \delta^{p''}(i)\right|\right\} \quad (32)$$

Next, an example of using the subframe memory 77 for memorizing the lighting pattern will be explained.

The lighting pattern is determined in the order of inputting the image data. In the case of a color display, the process is performed for each of red, green and blue colors. The following explanation is about the case of one color.

Figure 19:
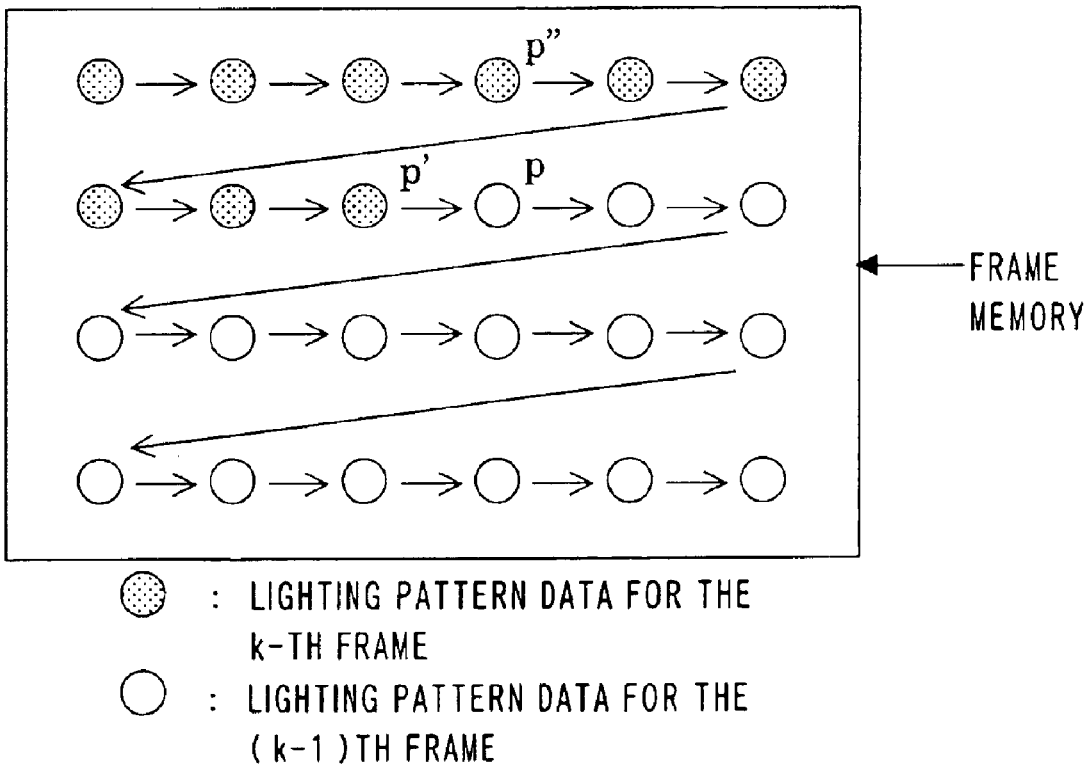
FIG. 19 shows the point of writing data into a subframe memory.

FIG. 19 shows a frame memory in the form of cell arrangement of a screen. Arrows in the figure shows the order of determining a lighting pattern. FIG. 19 shows the state where the lighting pattern in the k-th frame is determined for up to the cell p'. The next stage is that the lighting pattern of the cell p is determined. The frame memory memorizes the reference lighting pattern of the cell p in the (k−1)th frame and the reference lighting patterns of the cell p' and the cell p" in the k-th frame, which are read out for determining the lighting pattern of the cell p in the k-th frame. When the lighting pattern of the cell p in the k-th frame is determined, the lighting pattern of the cell p in the k-th frame is memorized in the place of the cell p in the (k−1)th frame, followed by determining the lighting pattern of the next cell.

VARITION 1

Figure 20:
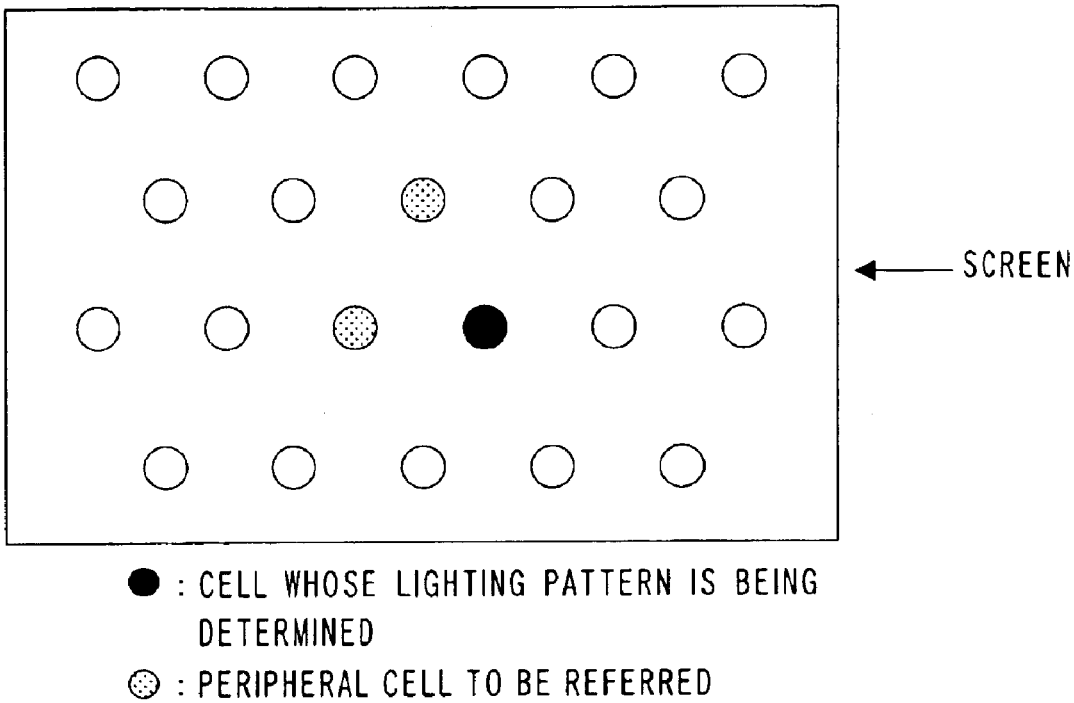
FIG. 20 shows a schematic diagram of a screen in a delta arrangement.
Figure 21A:
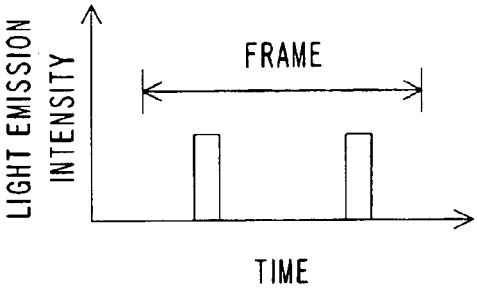
FIGS. 21A and 21B are diagrams for explaining an expansion of the light emission waveform.
Figure 21B:
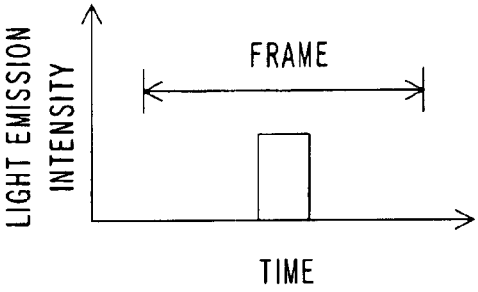
Figure 22:
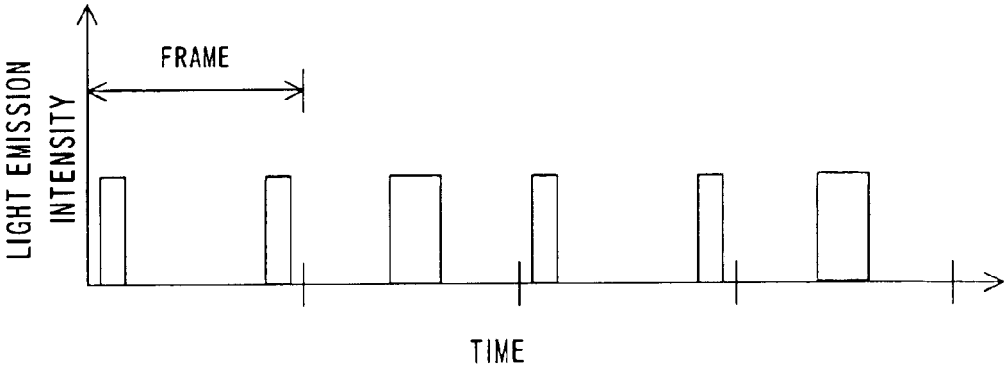
FIG. 22 shows a combination of lighting patterns in which flickers are conspicuous.
Figure 23:
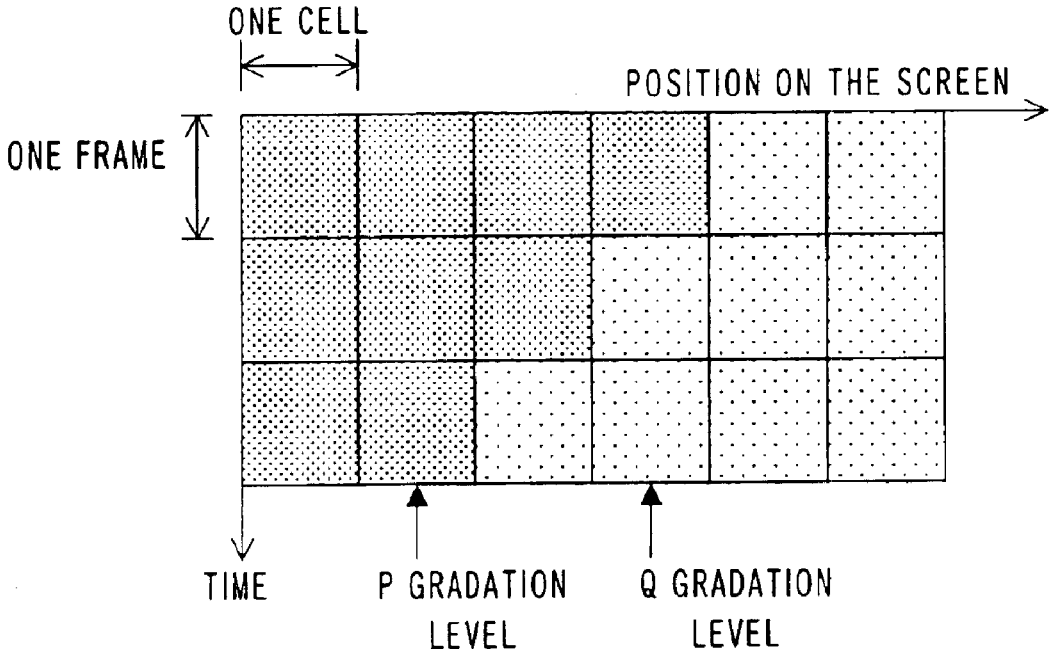
FIG. 23 shows a variation of a display when an object moves on the screen.
Figure 24:
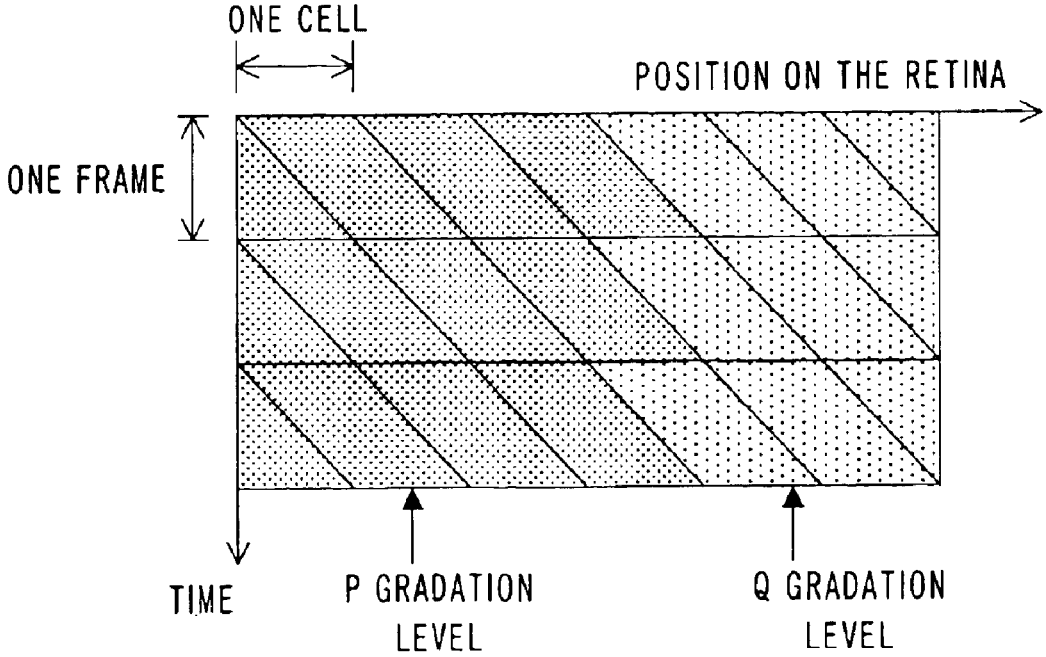
FIG. 24 shows the quantity of entering light on the retina when an object moves on the screen.
Figure 25:
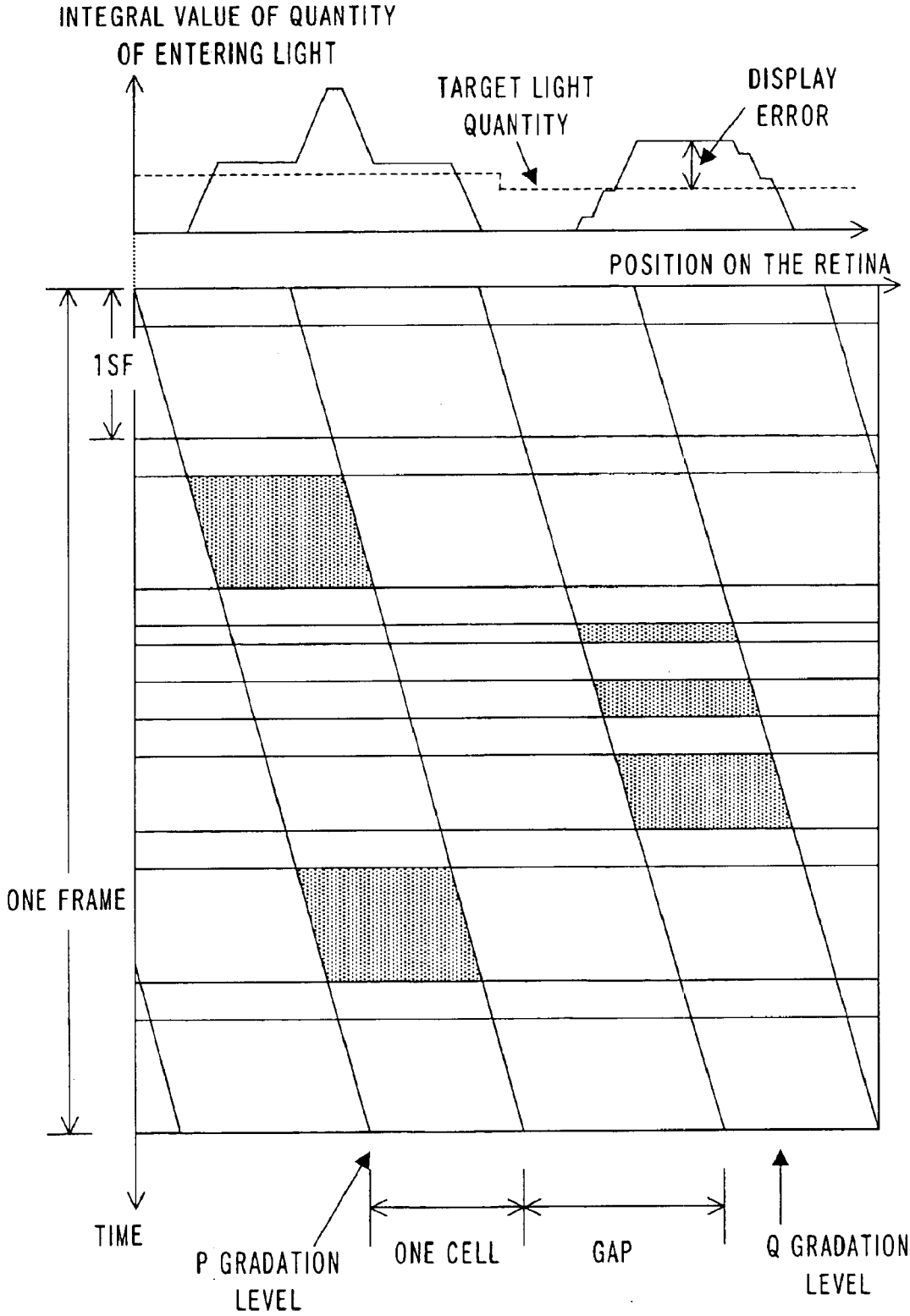
FIG. 25 shows the quantity of entering light on the retina when an object moves on the screen having a cell gap.
Figure 26:
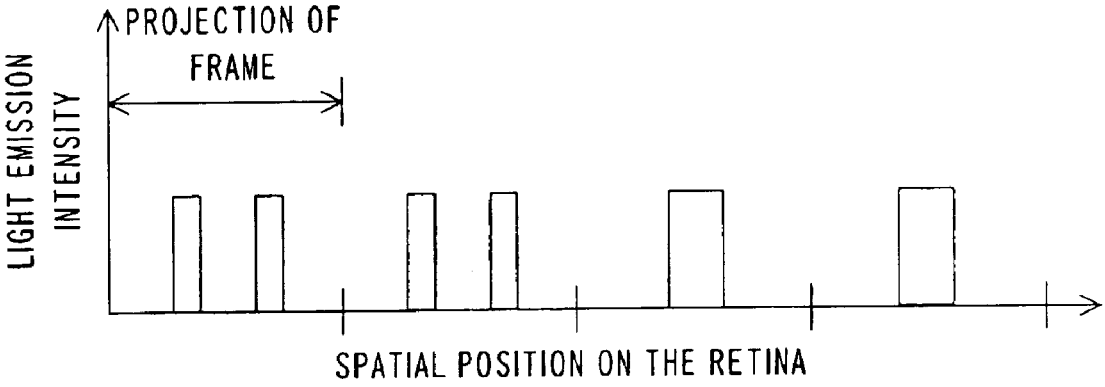
FIG. 26 shows a combination of lighting patterns in which pseudo contours are not conspicuous.

The cell arrangement is not limited to the square arrangement like a cross grid as shown in FIG. 2 but can be a delta arrangement as shown in FIG. 20. FIG. 20 shows an example of the relationship between positions of the noted cell and the neighboring reference cell.

While the presently preferred embodiments of the present invention have been shown and described, it will be understood that the present invention is not limited thereto, and that various changes and modifications may be made by those skilled in the art without departing from the scope of the invention as set forth in the appended claims.

What is claimed is:

1. A method for displaying an image in which a halftone is reproduced by a subframe technique of converting a frame into a plurality of subframes, the method comprising:

determining a lighting pattern that is a combination of on and off of the subframes for each of plural pixels of a display screen in accordance with a frame data value of a noted pixel, a lighting pattern of the noted pixel in a past frame and a lighting pattern determined for a peripheral pixel that is located in a vicinity of the noted pixel and has the same display color as the noted pixel, wherein:

intensity values of Fourier components of the difference between the light emission waveform indicated by the lighting pattern in the past frame and a target light emission waveform indicated by the frame data value; and intensity values of Fourier components of a light emission distribution error between the peripheral pixel and the noted pixel are determined so that a sum of the intensities after being weighted becomes a minimum.

2. A method as recited in claim 1, wherein the weight of the Fourier components having a frequency above a flicker frequency is set to zero among the Fourier components of the difference between the light emission waveform indicated by the lighting pattern in the past frame and the target light emission waveform indicated by the frame data value.

3. A method as recited in claim 1, wherein the determining a lighting pattern uses only the components corresponding to the period twice the pixel pitch among the Fourier components of the light emission distribution error between the peripheral pixel and the noted pixel.

4. A method for displaying an image in which a halftone is reproduced by a subframe technique of converting a frame into a plurality of subframes, the method comprising:

determining a lighting pattern that is a combination of on and off of the subframes for each of plural pixels of a display screen in accordance with a frame data value of a noted pixel, a lighting pattern of the noted pixel in a past frame and a lighting pattern determined for a peripheral pixel that is located in a vicinity of the noted pixel and has the same display color as the noted pixel, wherein:

a lighting pattern is regarded as a coordinate value so that the sum of a distance to the lighting pattern of the past frame and a distance to the lighting pattern determined for the peripheral pixel becomes a minimum.

5. A method for displaying an image in which a halftone is reproduced by a subframe techniciue of converting a frame into a plurality of subframes, the method comprising:

determining a lighting pattern that is a combination of on and off or the subframes for each of plural pixels of a display screen in accordance with a frame data value of a noted pixel, a lighting pattern of the noted pixel in a past frame and a lighting pattern determined for a peripheral pixel that is located in a vicinity of the noted pixel and has the same display color as the noted pixel, wherein:

only a part of the plurality of subframes is noted, the lighting pattern of the past frame and the lighting pattern determined for the peripheral pixel are referred, and the lighting pattern is regarded as a coordinate value, so that a sum of a distance to the lighting pattern in the past frame and a distance to the lighting pattern determined for the peripheral pixel becomes a minimum value.

* * * * *

UNITED STATES PATENT AND TRADEMARK OFFICE

CERTIFICATE OF CORRECTION

PATENT NO. : 6,909,441 B2
DATED : June 21, 2005
INVENTOR(S) : Yasunobu Hashimoto It is certified that error appears in the above-identified patent and that said Letters Patent is hereby corrected as shown below:

Column 16,
Line 2, after “value” delete “;”.
Line 38, change “techniciue” to -- technique --.
Line 41, change “or” to -- of --.

Signed and Sealed this

Fourteenth Day of March, 2006

JON W. DUDAS
*Director of the United States Patent and Trademark Office*